US006087080A

United States Patent [19]

Gavney, Jr. et al.

[11] Patent Number: 6,087,080

[45] Date of Patent: Jul. 11, 2000

[54] REDUCTION OF THE SENSITOMETRIC TOE AREA OF PHOTOGRAPHIC FILMS

[75] Inventors: James A. Gavney, Jr., St. Paul; James E. Lindquist, Stillwater, both of Minn.

[73] Assignee: Minnesota Mining & Manufacturing Company, St. Paul, Minn.

[21] Appl. No.: 08/406,706

[22] Filed: Mar. 20, 1995

[51] Int. Cl.[7] ..... G03C 1/40; G03C 1/83

[52] U.S. Cl. ..... 430/521; 430/517; 430/529; 430/944; 430/966

[58] Field of Search ..... 430/521, 944, 430/966, 529, 559, 517

[56] References Cited

U.S. PATENT DOCUMENTS

| | | | |
|---|---|---|---|
| 1,753,911 | 4/1930 | Wendt . | |
| 2,504,593 | 4/1950 | Schoen et al. . | |
| 2,865,752 | 12/1958 | Saunders et al. . | |
| 3,449,122 | 6/1969 | Kretchman et al. | 430/521 |

FOREIGN PATENT DOCUMENTS

| | | |
|---|---|---|
| 62-014152 | 1/1987 | Japan . |
| 03100645 | 4/1991 | Japan . |

*Primary Examiner*—Thorl Chea

[57] ABSTRACT

A negative-acting silver halide photographic element comprising a hydrophilic colloidal binder containing a silver halide emulsion and from 50 to 1000 milligrams of an anthraquinone per mole of silver halide.

14 Claims, No Drawings

REDUCTION OF THE SENSITOMETRIC TOE AREA OF PHOTOGRAPHIC FILMS

BACKGROUND OF THE INVENTION

1. Field of the Invention

This invention relates to photographic elements containing silver halide crystals or grains as the light sensitive particles and to methods of controlling the sensitometric response curve especially in the toe of the curve, i.e., the part of the curve corresponding to the most sensitive crystals or sensitive reponse of crystals in the photographic film.

2. Background of the Art

The response of a photographic film to radiation exposure (either to wavelengths of native sensitivity or to regions of the electromagnetic spectrum to which the grains have been spectrally sensitized) is measured by a sensitometric curve. A sensitometric curve is traditionally a graphic representation of the relationship between the energy used to expose the photographic element (usually expressed as "logE," the logarithm of the energy) versus the optical density (usually "D" generated in the photographic element after photographic development). The film is exposed to a graduated light intensity and the film's response (usually measured as optical density after development) as a function of the light gradation is measured. The part of the response curve where the film first begins to respond to an exposure is called the toe of the curve. While most of the density of an image is produced at higher exposures than that needed to expose the toe area, there are important features of the image which are determined by the toe area. In films used for graphic arts purposes, the edges of a half tone dot may be controlled by the sensitometry of the toe area of the curve. A large toe area produces a low density shadow around the dot known as a soft dot and this is undesirable for films used to subsequently expose a printing plate.

Medical radiographic films, especially those exposed by laser imaging devices, exhibit most of their information in the main part of the sensitometric curve; but a long toe area can cause the appearance of blurred alphanumeric characters on the image and a higher background density in the regions of lowest exposure.

We have found that the shape of the toe area of such films can be modified by the addition to the photographic emulsion of a class of organic compound.

BRIEF DESCRIPTION OF THE INVENTION

We have discovered that the toe area of a photographic film's sensitometric curve can be restrained by the inclusion in the emulsion of soluble anthraquinones. The shorter toe area of an infra-red sensitive film, particularly an infrared radiation-sensitive medical X-ray film, gives sharper alphanumerics and lower minimum density when the film contains the toe restrainers of the present invention and is exposed to a laser diode. We have discovered that the addition to the emulsion of a derivative of anthraquinone reduces the length of the toe area of such films without adversely affecting the response in the rest of the sensitometric curve.

DETAILED DESCRIPTION OF THE INVENTION

Photographic films are used in many types of imaging systems where different demands are made of the film's response to exposure. Normally the use of the film is determined by the major part of the sensitometric curve which reflects the response of the film to an exposure used in practical applications intended for the particular type of film. Special imaging applications may place tighter demands on certain areas of the sensitometric curve such as the shoulder or the toe of the curve. Examples where the toe area is important are graphic arts films where the toe can determine the appearance of the edges of half tone dots and laser imaged medical films where the toe area of the curve can influence the appearance of the alphanumeric characters in an image and may contribute to an apparent high minimum density of the image.

Films imaged by a laser diode should preferably exhibit a sensitometric curve appropriate for the relatively short exposure range provided by such lasers. Laser diodes often can only be modulated to give an exposure range of 80:1 or 100:1. This translates to a logarithmic exposure of 1.9 to 2.0 LogE. Films intended for use in such imaging systems should therefore be able to generate a full range of densities from minimum to the desired maximum when exposed to this variation in light. Films with an extended toe area will not produce a true minimum density even at the lowest exposure possible from a laser diode and thus there will be a higher than minimum density in such areas of the image. The minimum density areas of the general image will appear grey and the areas of the alphanumerics characters on the image, expected to be at minimum density, will also appear grey or clouded. This is aesthetically unpleasing and also may make the characters difficult to read.

We have found that the size of the toe area of the sensitometric curve of films intended for laser imaging can be reduced by incorporation into the emulsion of compounds containing the anthraquinone structure. Such compounds can be added to the emulsion at any stage prior to the coating operation and have little effect on the main part of the sensitometric curve. It is preferable that they are soluble in water or water miscible solvents to allow their easy incorporation into the emulsion. Solubility can be modified by suitable groups attached to the anthraquinone ring system, such as carboxylate groups, sulfonate groups, etc. as well known in the photographic art.

The general structure of the compounds we have found effective in reducing the toe area of the sensitometric curve can be represented by:

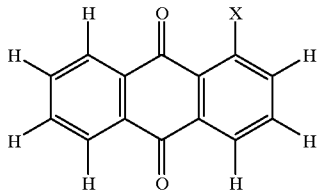

where X can be one or more various substituents to confer higher solubility on the anthraquinone molecule such as sulfonic acid, hydroxy, amino, carboxylic acid, etc. The general structure can contain one or more such substituents. Compounds were obtained from Aldrich Chemical Milwaukee, Wis.

Depending on the exact anthraquinone derivative chosen, the desired effect can be obtained by the addition to the emulsion of 20 to 1000 milligrams of the compound to a mole of silver halide. More preferable is the addition of between 50 and 500 milligrams per mole of silver halide.

While the exact mode of action of such compounds which allows them to reduce the toe area of a sensitometric curve is not obvious, it is possible that it is in some way similar to the action of quinones in "lithographic" developers. Lithographic developers are purposely formulated to contain very little sulfite as preservative and antioxidant. As a result, any quinone produced by oxidation of hydroquinone during the development process remains active in the developer where it restrains development of the most reactive emulsion crystals which would normally form image density in the toe area of the sensitometric curve.

Normal developers, such as those used to develop medical X-ray films, contain high levels of sulfite and any semiquinones produced during the development process are reacted with the sulfite and very little free quinone is available to control toe area. Anthraquinone compounds contain the quinone moiety, but reaction with sulfite at the positions ortho to the keto quinone group is prevented by the aromatic rings condensed on both sides of the quinone ring in an anthraquinone structure. As a result of this structure, the action of the quinone in retarding development in the toe area can occur even in the presence of large excesses of sulfite as normally found in X-ray developers.

Any of the various types of photographic silver halide emulsions may be used in the practice of the present invention. Silver chloride, silver bromide, silver bromoiodide, silver chlorobromide, silver bromochloride, silver bromochloroiodide, silver chlorobromoiodide and mixtures thereof may be used for example.

Any configuration of grains, cubic, orthorhombic, hexagonal, tabular, epitaxial or mixtures thereof may be used. These emulsions are prepared by any of the well known procedures, e.g., single or double jet emulsions as described by Wietz et al., U.S. Pat. No. 2,222,264, Illingsworth, U.S. Pat. No. 3,320,069, McBride, U.S. Pat. No. 3,271,157 and U.S. Pat. Nos. 4,425,425 and 4,425,426.

The silver halide emulsions of this invention may be unwashed or washed to remove soluble salts by products. In the latter case, the soluble salts can be removed by chill setting and leaching or the emulsion can be coagulation washed, e.g., by the procedure described by Hewitson et al., U.S. Pat. No. 2,618,556; Yutzy et al., U.S. Pat. No. 2,614,928; Yackel, U.S. Pat. No. 2,565,418; Hart et al., U.S. Pat. No. 3,241,969; and Waller et al., U.S. Pat. No. 2,489,341.

Silver halide emulsions of this invention can be protected against the production of fog and stabilized against changes in sensitivity during keeping by the addition of antifoggants and stabilizers alone or in combination, these can include the thiazolium salts described in Staud, U.S. Pat. No. 2,131,038 and Allen U.S. Pat. No. 2,694,716; the azaindines described in Piper, U.S. Pat. No. 2,886,437 and Heimbach U.S. Pat. No. 2,444,605; the mercury salts described in Allen, U.S. Pat. No. 2,728,663; the urazoles described in Anderson, U.S. Pat. No. 3,287,135; the sulphocatechols described in Kennard, U.S. Pat. No. 3,235,652; the oximes described in Carrol et al., British Patent 623,448; nitron; nitroindazoles; the polyvalent metal salts described in Jones, U.S. Pat. No. 2,839,405; the thiuronium salts described in Herz, U.S. Pat. No. 3,220,839; and the palladium, platinum and gold salts described in Trivelli, U.S. Pat. No. 2.566,263 and Damschroeder, U.S. Pat. No. 2,597,915.

Silver halide emulsions in accordance with this invention can be dispersed in various hydrophilic colloids alone or in combination as vehicles or binding agents. Suitable hydrophilic materials include both naturally occurring substances such as proteins, for example gelatins derived animal bones and hides by the acid or liming process and chemically modified gelatins e.g. (phthalated, succinylated etc.) cellulose derivatives, polysaccharides, such as dextran, gum arabic and the like; and synthetic substances such as water soluble polyvinyl compounds, e.g. poly(vinyl pyrrolidone), acrylamide polymers or other synthetic polymeric compounds such as dispersed vinyl compound in latex form, and particularly those that increase the dimensional stability of photographic materials. Suitable synthetic polymers include those described, for example, in U.S. Pat. No. 3,142,568 of Nottorf; U.S. Pat. No. 3,193,386 of White; U.S. Pat. No. 3,062,674 of Houck, Smith and Yudelson; U.S. Pat. No. 3,220,844 of Houck, Smith and Yudelson; Ream and Fowler, U.S. Pat. No. 3,287,289; and Dykstra, U.S. Pat. No. 3,411,911; particularly effective are those water insoluble polymers of alkyl acrylates and methacrylates, acrylic acid, sulfoalkyl acrylates or methacrylates, those which have cross linking site which facilitate hardening or curing and those having recurring sulfobetaine units as described in Canadian Patent 774,054.

Photographic silver halide emulsions of this invention can be dispersed in colloids that may be hardened by various organic and inorganic hardeners, alone or in combination, such as the aldehydes, ketones, carboxylic and carbonic acid derivatives, sulfonate esters, sulfonyl halides, and vinyl sulfones, active halogen compounds, epoxy compounds, aziridines, active olefins, isocyanates, carbodiimides, mixed function hardeners such as oxidized polysaccharides, e.g., dialdehyde starch, oxyguargum, etc.

Emulsions in accordance with this invention can be used in photographic elements which contain antistatic or conducting layers, such as layers that comprise soluble salts, e.g. chlorides, nitrates etc., evaporated metal layers, ionic polymers such as those described in Minsk, U.S. Pat. Nos. 2,861,056 and 3,206,312 or insoluble inorganic salts such as those described in Trevoy, U.S. Pat. No. 3,428,451.

The photographic emulsions of this invention can be coated on a wide variety of supports. Typical supports include polyester film, subbed polyester film, poly(ethylene terephthalate) film, polyethylene naphthalate film, cellulose ester film, poly(vinyl acetal) film, poly carbonate film, and related resinous materials, as well as glass, metal, paper and the like. Typically in a photographic print, a flexible support is employed, especially a paper support, which can be partially acetylated or coated with baryta and/or an alpha-olifin polymer, particularly a polymer of an alpha-olefin containing 2 to 10 carbon atoms such as polyethylene, polypropylene, ethylenebutene co-polymers and the like.

Emulsions of this invention can contain plastisizers and lubricants such as polyalcohols, e.g., glycerin and diols of the type described in Milton, U.S. Pat. No. 2,960,404, fatty acids or esters such as those described in Robins, U.S. Pat. No. 2,588,765 and Duane, U.S. Pat. No. 3,121,060; and silicone resins such as those described in DuPont British Patent 955,061.

The photographic emulsions as described herein can contain surfactants such as saponin, anionic compounds such as the alkylarylsulfonates described in Baldsiefen, U.S. Pat. No. 2,600,831 fluorinated surfactants, and amphoteric compounds such as those described in Ben-Ezra, U.S. Pat. No. 3,133,816.

Photographic elements containing emulsion layers as described herein can contain matting agents such as starch, titanium dioxide, silica, zinc oxide, polymeric beads including beads of the type described in Jelley et al., U.S. Pat. No. 2,992,101 and Lynn, U.S. Pat. No. 2,701,245.

Emulsions of the invention can be utilized in photographic elements which contain brightening agents including stilbene, triazine, oxazole and coumarin brightening agents. Water soluble brightening agents can be used such as those described in Alberset al., German Patent 927,067 and McFall et al., U.S. Pat. No. 2,933,390 or dispersions of brighteners can be used such as those described in Jansen, German Patent 1,150,274 and Oetiker et al., U.S. Pat. No. 3,406,070.

Photographic elements containing emulsion layers according to the present invention can be used in photographic elements which contain light absorbing materials and filter dyes such as those described in Sawdey, U.S. Pat. No. 3,253,921; Gaspar, U.S. Pat. No. 2,274,782; Carrol et al., U.S. Pat. No. 2,257,583 and Van Campen U.S. Pat. No. 2,956,879. If desired the dyes may be mordanted, for example as described in Milton and Jones, U.S. Pat. No. 3,282,699.

Contrast enhancing additives such as hydrazines, rhodium, iridium, and combinations thereof are also useful.

Photographic emulsions of this invention can be coated by various coating procedures including dip coating, air knife coating curtain coating, or extrusion coating using hoppers of the type described in Beguin, U.S. Pat. No. 2,681,294. If desired, two or more layers may be coated simultaneously by the procedures described in Russell, U.S. Pat. No. 2,761, 791 and Wynn British Patent 837,095.

The silver halide photographic elements can be used to form dye images therein through the selective formation of dyes. The photographic elements described above for forming silver images can be used to form dye images by employing developers containing dye image formers, such as color couplers, as illustrated by U.K. Patent 478,984; Yager et al., U.S. Pat. No. 3,113,864; Vittum et al., U.S. Pat. Nos. 3,002,836, 2,271,238 and 2,362,598. Schwan et al., U.S. Pat. No. 2,950,970; Carroll et al., U.S. Pat. No. 2,592, 243; Porter et al., U.S. Pat. Nos. 2,343,703, 2,376,380 and 2,369,489; Spath U.K. Patent 886,723 and U.S. Pat. No. 2,899,306; Tuite U.S. Pat. No. 3,152,896 and Mannes et al., U.S. Pat. Nos. 2,115,394, 2,252,718 and 2,108,602, and Pilato U.S. Pat. No. 3,547,650. In this form the developer contains a color developing agent, e.g., a primary aromatic amine which in its oxidized form is capable of reacting with the coupler (coupling) to form the image dye. Also, instant self-developing diffusion transfer film can be used.

The dye forming couplers can be incorporated in the photographic elements, as illustrated by Schneider et al., Die Chemie, Vol. 57, 1944 p. 113, Mannes et al., U.S. Pat. No. 2,304,940, Martinez U.S. Pat. No. 2,269,158, Jelley et al., U.S. Pat. No. 2,376,697, Fierke et al., U.S. Pat. No. 2,801, 171, Smith U.S. Pat. No. 3,748,141, Tong U.S. Pat. No. 2,772,163, Thirtle et al., U.S. Pat. No. 2,835,579, Sawdey et al., U.S. Pat. No. 2,533,514, Peterson U.S. Pat. No. 2,353, 745, Seidel U.S. Pat. No. 3,409,435, and Chen Research Disclosure, Vol. 159, July 1977, Item 15930. The dye forming couplers can be incorporated in different amounts to achieve differing photographic effects. For example, U.K. Patent 923,045 and Kumai et al., U.S. Pat. No. 3,843,369 teach limiting the concentration of coupler in relation to the silver coverage to less than normally employed amounts in faster and intermediate speed emulsion layers.

The dye forming couplers are commonly chosen to form subtractive primary (i.e., yellow, magenta and cyan) image dyes and are non-diffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high boiling organic (coupler) solvents.

The couplers may be present either directly bound by a hydrophilic colloid or carried in a high boiling organic solvent which is then dispersed within a hydrophilic colloid. The colloid may be partially hardened or fully hardened by any of the variously known photographic hardeners. Such hardeners are free aldehydes, U.S. Pat. No. 3,232,764, aldehyde releasing compounds, U.S. Pat. Nos. 2,870,013 and 3,819,608, s-triazines and diazines U.S. Pat. Nos. 3,325, 287 and 3,992,366, aziridines, U.S. Pat. No. 3,217,175, vinylsulfones, U.S. Pat. No. 3,490,911, carboimides and the like may be used.

Other conventional photographic addenda such as coating aids, spectral sensitizers, antistatic agents, accutance dyes, antihalation dyes, antifoggants, stabilizers, latent image stabilizers, antikinking agents, lubricating agents, matting agents and the like may also be present.

EXAMPLES

Definition and measurement of toe area.

Experimental films described below were tested by exposure to a graduated light source produced by passing the light from a laser diode through a graduated neutral density filter onto the film sample. The exposed film was processed in a conventional X-ray developer and fixer. The photographic response of the film was measured by scanning the density of the developed image to obtain the ususal sensitometric curve. The toe area of the curve is defined in the following results as: the area above Dmin between the LogE exposure at 0.25 density above Dmin and 0.5 LogE on the sensitometric curve.

The infrared sensitizing dye, dye A, used in the examples was: 3-ethyl-5,6-dimethyl-2-(2-(3-(2-(3-ethyl-5,6-dimethyl-2-benzoxazole)-ethylene)-2-chlorocyclopent-1-enyl)-ethylene)benzoxazolium iodide.

Example 1

A pure silver bromide emulsion consisting of crystals 0.24 μm diameter was chemically sensitized by N-methyl thio succinate and sodium tetrachloroaurate. After sensitization to optimum levels, the emulsion was stabilized by the addition of tetraazaindene.

Prior to spectral sensitization, anthraquinone 2-sulfonic acid was added in the range of 50 to 800 mg/mole. Spectral sensitization to a wavelength of 820 nm was from the addition of dye A. The dye was supersensitized by the styrene triazine compound Leucophor BCF manufactured by the Sandoz Company. Prior to coating onto 7 ml polyester, further compounds were added to ensure good coating quality such as surfactants and to harden the gelatin such as formaldehyde. Examination of the early exposure region of the sensitometric curve reveals a reduction in the toe area with increased amounts of anthraquinone sulfonic acid up to 400 mg (table 1). Additional amounts of anthraquinone 2-sulfonic acid results in a slight increase in toe area.

TABLE 1

| mg Anthraquinone 2-Sulfonic Acid | Toe Area (Density LogE) |
|---|---|
| 0 | 0.514 |
| 50 | 0.499 |
| 100 | 0.501 |
| 200 | 0.487 |
| 400 | 0.483 |
| 800 | 0.499 |

Example 2

A pure silver bromide emulsion consisting of crystals 0.12 μm diameter was chemically sensitized by N-methyl thio succinate and sodium tetrachloroaurate. After sensitization to optimum levels, the emulsion was stabilized by the addition of tetraazaindene.

Prior to spectral sensitization, anthraquinone 2-sulfonic acid was added in the range of 50 to 800 mg/mole. Spectral sensitization to a wavelength of 820 nm was from the addition of dye A. The dye was supersensitized by the styrene triazine compound Leucophor BCF manufactured by the Sandoz Company. Prior to coating onto 7 mil polyester further compounds were added to ensure good coating quality such as surfactants and to harden the gelatin such as formaldehyde. Examination of the early exposure region of the sensitometric curve reveals a reduction in the toe area with increased amounts of anthraquinone sulfonic acid up to 800 mg (table 2).

TABLE 2

| mg Anthraquinone 2-Sulfonic Acid | Toe Area (Density LogE) |
|---|---|
| 0 | 0.507 |
| 100 | 0.495 |
| 200 | 0.491 |
| 300 | 0.485 |
| 400 | 0.488 |
| 500 | 0.481 |
| 800 | 0.499 |

Example 3

Prior to chemical sensitization of a pure silver bromide emulsion consisting of crystals 0.24 $\mu$m diameter, anthraquinone 2-sulfonic acid was added the range of 75 to 300 mg/mole. Following this addition, the emulsion was chemically sensitized by N-methyl thio succinate and sodium tetrachloroaurate. After sensitization to optimum levels, the emulsion was stabilized by the addition of tetraazaindene.

Spectral sensitization to a wavelength of 820 nm was from the addition of dye A. The dye was supersensitized by the styrene triazine compound Leucophor BCF manufactured by the Sandoz Company. Prior to coating onto 7 mil polyester, further compounds were added to ensure good coating quality such as surfactants and to harden the gelatin such as formaldehyde. Examination of the early exposure region of the sensitometric curve reveals a reduction in the toe area with increased amounts of anthraquinone sulfonic acid up to 300 mg (table 3). In fact the compounds anthraquinone 2-sulfonic acid is most effective for reduction of the toe area when it is added prior to chemical sensitization.

TABLE 3

| mg Anthraquinone 2-Sulfonic Acid | Toe Area (Density LogE) |
|---|---|
| 0 | 0.519 |
| 75 | 0.494 |
| 150 | 0.487 |
| 300 | 0.465 |

What we claim is:

1. An infrared spectrally sensitized negative-acting silver halide photographic element comprising a hydrophilic colloidal binder containing a silver halide emulsion and from 50 to 1000 milligrams of an anthraquinone per mole of silver halide.

2. The element of claim 1 wherein said anthraquinone has a water-solubilizing group bonded to an aromatic ring on said anthraquinone.

3. The element of claim 2 wherein said element is a black-and-white photographic element.

4. The element of claim 2 wherein said water-solubilizing group is selected from the class consisting of sulfonic acid, sulfonic acid salts, sulfonate, sulfinic acid, sulfinic acid salts, carboxylic acid, and carboxylic acid salts.

5. The element of claim 4 wherein said element is a black-and-white photographic element.

6. The element of claim 4 wherein said silver halide emulsion is spectrally sensitized to the infrared region of the electromagnetic spectrum between 720 and 1000 nm.

7. The element of claim 1 wherein said element is a black-and-white photographic element.

8. The element of claim 1 wherein said silver halide emulsion is spectrally sensitized to the infrared region of the electromagnetic spectrum between 720 and 1000 nm.

9. An infrared spectrally sensitized negative-acting silver halide photographic element comprising a hydrophilic colloidal binder containing a silver halide emulsion free of radiation-exposure generated latent image and from 50 to 1000 milligrams of an anthraquinone per mole of silver halide.

10. The element of claim 9 wherein said anthraquinone has a water-solubilizing group bonded to an aromatic ring on said anthraquinone.

11. The element of claim 10 wherein said water-solubilizing group is selected from the class consisting of sulfonic acid, sulfonic acid salts, sulfonate, sulfinic acid, sulfinic acid salts, carboxylic acid, and carboxylic acid salts.

12. The element of claim 9 wherein said element is a black-and-white photographic element.

13. The element of claim 12 wherein said silver halide emulsion is spectrally sensitized to the infrared region of the electromagnetic spectrum between 720 and 1000 nm.

14. The element of claim 9 wherein said silver halide emulsion is spectrally sensitized to the infrared region of the electromagnetic spectrum between 720 and 1000 nm.

* * * * *